US010934061B2

(12) United States Patent
Peck

(10) Patent No.: US 10,934,061 B2
(45) Date of Patent: Mar. 2, 2021

(54) OXYGEN INGRESS CONTROLLING CAP CLOSURE

(71) Applicant: G3 Enterprises, Inc., Modesto, CA (US)

(72) Inventor: James Peck, Modesto, CA (US)

(73) Assignee: G3 ENTERPRISES, INC., Modesto, CA (US)

( * ) Notice: Subject to any disclaimer, the term of this patent is extended or adjusted under 35 U.S.C. 154(b) by 0 days.

(21) Appl. No.: 13/725,983

(22) Filed: Dec. 21, 2012

(65) Prior Publication Data

US 2013/0161282 A1 Jun. 27, 2013

Related U.S. Application Data

(60) Provisional application No. 61/579,611, filed on Dec. 22, 2011.

(51) Int. Cl.

| | |
|---|---|
| ***B65D 41/02*** | (2006.01) |
| ***B65D 41/04*** | (2006.01) |
| ***B65D 53/04*** | (2006.01) |
| ***B65B 3/02*** | (2006.01) |

(52) U.S. Cl.

CPC ..... *B65D 41/026* (2013.01); *B65B 3/02* (2013.01); *B65D 41/045* (2013.01); *B65D 53/04* (2013.01)

(58) Field of Classification Search

CPC .... B65D 41/026; B65D 53/04; B65D 41/045; B32B 5/18; B65B 3/02; B29C 47/06

USPC ..... 215/341, 232, 364, 347, 228, 201, 203

See application file for complete search history.

(56) References Cited

U.S. PATENT DOCUMENTS

| | | | | |
|---|---|---|---|---|
| 5,673,809 | A | 10/1997 | Ohmi et al. | |
| 5,829,608 | A | 11/1998 | Clerget | |
| 6,082,566 | A * | 7/2000 | Yousif et al. | 215/232 |
| 6,139,931 | A * | 10/2000 | Finkelstein et al. | 428/36.6 |
| 6,866,926 | B1 * | 3/2005 | Smelko et al. | 428/319.1 |
| 6,902,075 | B2 * | 6/2005 | O'Brien et al. | 215/232 |
| 7,798,359 | B1 * | 9/2010 | Marsella | 220/359.3 |
| 8,703,265 | B2 * | 4/2014 | Thorstensen-Woll et al. | 428/66.4 |
| 2002/0012808 | A1 * | 1/2002 | Ishizaki et al. | 428/516 |
| 2002/0162818 | A1 | 11/2002 | Williams | |
| 2004/0191445 | A1 | 9/2004 | Baranowski et al. | |

(Continued)

FOREIGN PATENT DOCUMENTS

| | | | |
|---|---|---|---|
| CN | 101891031 | A | 11/2010 |
| FR | 1226696 | A | 7/1960 |

(Continued)

OTHER PUBLICATIONS

Supplementary European Search report dated Aug. 25, 2017 in corresponding EP Application No. EP15744075, filed Jul. 27, 2016, Inventor(s) Torrison, Miriam, et al.

(Continued)

*Primary Examiner* — Ernesto A Grano

(74) *Attorney, Agent, or Firm* — Goodwin Procter LLP

(57) ABSTRACT

Systems and methods for controlling oxygen ingress in cap closures are herein disclosed. According to one embodiment, the current apparatus includes a cap and a cap liner. The cap liner includes a primary oxygen barrier layer and a first diffusive layer. A first side of the first diffusive layer is adjacent to a first side of the primary oxygen barrier layer. A second &de of the first diffusive layer contacts a lip-sealing surface of a bottle. The oxygen transmission rate of the cap liner is controlled by varying a thickness of the first diffusive layer.

9 Claims, 12 Drawing Sheets

(56) References Cited

U.S. PATENT DOCUMENTS

| | | | | |
|---|---|---|---|---|
| 2007/0007229 | A1* | 1/2007 | Yousif | 215/232 |
| 2007/0298273 | A1* | 12/2007 | Thies | B32B 27/32 428/516 |
| 2009/0026166 | A1 | 1/2009 | Druitt | |
| 2009/0123766 | A1 | 5/2009 | Peck | |
| 2009/0208729 | A1* | 8/2009 | Allegaert et al. | 428/319.9 |
| 2010/0213193 | A1* | 8/2010 | Helmlinger et al. | 220/200 |
| 2012/0067842 | A1 | 3/2012 | Keller | |
| 2012/0111758 | A1* | 5/2012 | Lo | 206/524.6 |
| 2012/0118764 | A1* | 5/2012 | Valus et al. | 206/213.1 |

FOREIGN PATENT DOCUMENTS

| | | | |
|---|---|---|---|
| FR | 1249847 | A | 1/1961 |
| FR | 1279992 | A | 12/1961 |
| FR | 2821064 | A1 | 8/2002 |
| WO | WO-2004070410 | A1 | 8/2004 |
| WO | WO-2006113000 | A2 | 10/2006 |
| WO | WO-2006113000 | A3 | 10/2006 |

OTHER PUBLICATIONS

International Search Report dated Feb. 22, 2013 in corresponding PCT Application No. PCT/US2012/71444 filed Dec. 21, 2012, inventor, Peck, James.

Evergreen, The barrier performance of common plastic film, www.evergreen-packaging.com.

Buntinx,Mieke, et al., Evaluation of the Thickness and Oxygen Transmission Rate Before and After Thermoforming Mono-and Multi-layer Sheets into Trays with Variable Depth; Polymers ISSN 2073-4360; www,mdpi.com/journal/polymers.

* cited by examiner

OXYGEN INGRESS CONTROLLING CAP CLOSURE

The present application claims the benefit of and priority to U.S. Provisional Application Ser. No. 61/579,611, entitled "Method for Controlling Oxygen Ingress in Aluminum Cap Closure", filed on Dec. 22, 2011, and is hereby incorporated by reference.

FIELD OF TECHNOLOGY

The present application relates in general to methods controlling oxygen ingress in cap closures. In particular, the present application is directed to methods controlling oxygen transmission in cap liners.

BACKGROUND

Most wines exhibit a chemical oxygen demand required for the proper development of flavors, mouth feel and aromas. This development is termed "wine maturation". A cap closure that allows the correct amount of oxygen into a wine bottle will promote wine maturation at an ideal rate, otherwise referred to as aging. If a cap closure has no oxygen barrier, too much oxygen will cause the wine to oxidize rapidly and shorten its shelf life. It is commonly known within the wine industry that white wines are much more sensitive to oxygen while red wines are generally more tolerant of exposure to oxygen. It is generally accepted that the proper amount of oxygen entering the wine at a proper rate through the closure will have a beneficial effect on wine quality.

The traditional closure for wine is the bark of the Quercus Suber, commonly known as cork oak. The oxygen transmission rate (OTR) of a premium natural cork is considered by many winemakers to be the gold standard. Premium wines using such corks are normally stored inverted or laid on their side. Storing wine in this manner reduces the OTR by keeping the cork wet, thus enhancing its sealing capabilities.

In the current wine industry, aluminum screw-cap closures have become a popular alternative to cork closures due to their low cost and predictable performance. The crucial sealing performance of a cap is controlled to a large extent by its liner component. Cap liners are required to seal sufficiently to prevent the beverage from leaking out of the package. They are also crucial for controlling the transmission of oxygen from the air outside the package into the product while retaining volatile flavor molecules in the beverage. Liner types have traditionally been chosen by cap manufacturers (e.g. G3), with a focus on ease of use, performance and price. It is commonly known in the cap closure industry that changing materials within the cap liner laminate structure can vary the OTR of the liner. However, it is not commonly known how to precisely select a combination of materials and their thicknesses to obtain a desired OTR over a range of OTR.

There are two major cut-disk cap liner technologies that dominate the cap liner industry (e.g. cap liners manufactured by MEYER SEALS), those containing SARANEX (a polyvinylidene chloride (PVDC)/polyethylene (PE) laminate that provides barrier protection) as an oxygen barrier and those utilizing a combination of SARANEX with either tin or aluminum foil as the oxygen barrier. The OTR of these two cap liner designs are uniform at their respective values, the foil-SARANEX being much lower than the SARANEX alone.

The SARANEX layer is typically thin, ranging from 1.0 to 2.0 mils. SARANEX itself is normally a five layer laminate, the outermost layers being low-density polyethylene (LDPE) film with adhesive layers (e.g. ethylene-vinyl acetate (EVA)) or a similar tie-layer polymer between the LDPE and the PVDC. The PVDC is the oxygen barrier component of SARANEX. Most of the total thickness of the SARANEX film is due to the layers of LDPE and adhesive. The LDPE and the adhesive layers have very high OTR relative to PVDC and metal foils. The SARANEX cap liner is considered by some to allow too much oxygen into the wine, leading to a decreased shelf-life. The foil-SARANEX cap liner is known to allow almost no oxygen into the wine bottle, which can cause anaerobic conditions resulting in reduced or sulfidic aromas. Therefore, some in the wine industry believe that foil-SARANEX liners allow in too little oxygen. OTR tests of inverted natural premium Flor grade corks using the OX-TRAN (a system for oxygen transmission rate testing) system from MOCON (a provider for oxygen permeation detection instruments) determined that their OTR values were between those of SARANEX and foil-SARANEX cap liners.

There are currently no commercial cap liners for wine screw caps that provide OTR values close to that of a premium inverted natural bark cork. One prior attempt to create this range of OTR values was made by producing liners using different thickness of ethylene vinyl alcohol (EVOH) in place of the SARANEX barrier. However, the OTR of three thicknesses of EVOH were virtually identical to each other and very close to the OTR of a SARANEX cap liner. Another prior attempt was made using perforated metalized polymer, which resulted in unacceptable variability in OTR values.

Another prior attempt to achieve the desired OTR included applying various perforation schemes through tin foil and then using the perforated foil to create a laminate liner similar to a foil-SARANEX liner. However, this produced neither the desired control of OTR, nor an OTR close to that of a wine package finished with a premium natural bark cork. The perforations in the foil, which may be known as the primary barrier, did not control the OTR. The OTR values of this configuration were similar to that of a foil-SARANX liner without perforations in the tin foil.

SUMMARY

Systems and methods for controlling oxygen ingress in cap closures are herein disclosed. According to one embodiment, the current apparatus includes a cap and a cap liner. The cap liner includes a primary oxygen barrier layer and a first diffusive layer. A first side of the first diffusive layer is adjacent to a first side of the primary oxygen barrier layer. A second side of the first diffusive layer contacts a lip-sealing surface of a bottle. The oxygen transmission rate of the cap liner is controlled by varying a thickness of the first diffusive layer, The above and other preferred features, including various novel details of implementation and combination of events, will now be more particularly described with reference to the accompanying figures and pointed out in the claims. It will be understood that the particular methods described herein are shown by way of illustration only and not as limitations. As will be understood by those skilled in the art, the principles and features described herein may be employed in various and numerous embodiments without departing from the scope of the invention.

BRIEF DESCRIPTION OF THE DRAWINGS

The accompanying figures, which are included as part of the present specification, illustrate the presently preferred embodiments of the present invention and together with the general description given above and the detailed description of the preferred embodiments given below serve to explain and teach the principles of the present invention.

FIG. 4(*b*) illustrates an exemplary plot of a factor effect in a model for OTR control, according to one embodiment.

FIG. 6(*b*) illustrates an exemplary plot of the effect of thickness of highly diffusive layers on OTR, according to one embodiment.

FIG. 6(*c*) illustrates an exemplary plot of the effect of different materials on OTR, according to one embodiment.

It should be noted that the figures are not necessarily drawn to scale and are only intended to facilitate the description of the various embodiments described herein. The figures do not describe every aspect of the teachings described herein and do not limit the scope of the claims.

DETAILED DESCRIPTION

A method for controlling oxygen ingress in cap closures is disclosed. According to one embodiment, the current apparatus includes a cap and a cap liner. The cap liner includes a primary oxygen barrier layer and a first diffusive layer. A first side of the first diffusive layer is adjacent to a first side of the primary oxygen barrier layer. A second side of the first diffusive layer contacts a lip-sealing surface of a bottle. The oxygen transmission rate of the cap liner is controlled by varying a thickness of the first diffusive layer.

The present disclosure describes a cap liner design that delivers OTR including a range of OTR between the OTR of SARANEX and foil-SARANEX liners, and an extended range of higher OTR. This allows the creation of custom OTR for cap closures. The present cap liner design provides the OTR of a premium bark cork, according to one embodiment. The present cap liner design provides the OTR of synthetic cork, according to another embodiment. The OTR of synthetic cork includes 0.001 cc O2/cap/day.

Figure 1:
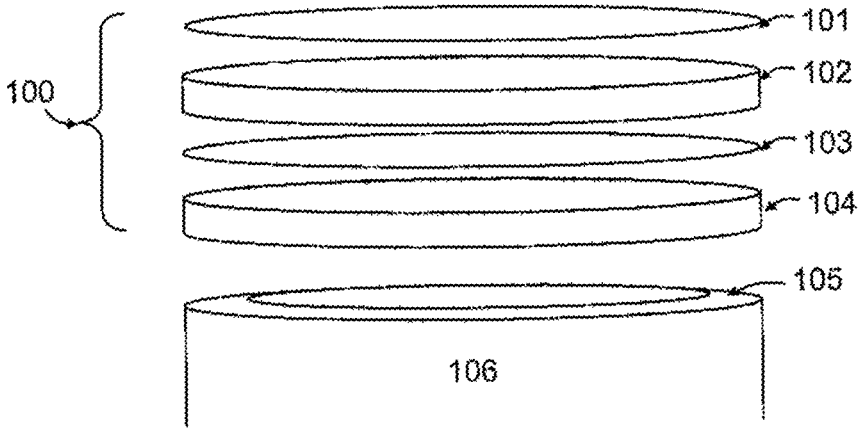
FIG. 1 illustrates an exploded view of components in a cap liner, according to one embodiment.

FIG. 1 illustrates an exploded view of components in a cap liner, according to one embodiment. The cap liner 100 includes a first highly diffusive layer 104, a primary oxygen barrier 103, a second highly diffusive layer 102, and a secondary oxygen barrier 101. The first side of the first highly diffusive layer 104 is adjacent to the first side of the primary oxygen barrier 103. The second side of the first highly diffusive layer 104 contacts the lip-sealing surface 105 of a bottle 106. The second side of the primary oxygen barrier 103 is adjacent to the first side of the second highly diffusive layer 102. The second side of the second highly diffusive layer 102 is adjacent to one side of the secondary oxygen barrier 101. The primary oxygen barrier 103 may include films made of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), metalized high-density polyethylene (HDPE), a metalized layer or any oxygen barrier known in the art, according to one embodiment. The secondary oxygen barrier 101 may include films made of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), metalized high-density polyethylene (HDPE), a metalized layer or any oxygen barrier known in the art, according to one embodiment. The first highly diffusive layer 104 and the second highly diffusive layer 102 may include one or more types of highly diffusive polymers known in the art, according to one embodiment. The first highly diffusive layer 104 and the second highly diffusive layer 102 may include, but are not limited to LDPE, EVA, ethylene acrylic acid (EAA), HPDE, LLDPE, and ULDPE films according to one embodiment. The first highly diffusive layer 104 and the second highly diffusive layer 102 may include one or more types of highly diffusive polymers known in the art, according to one embodiment. The OTR of the cap liner 100 is controlled by varying the thicknesses of the first highly diffusive layer 104 and the second highly diffusive layer 102.

Figure 2:
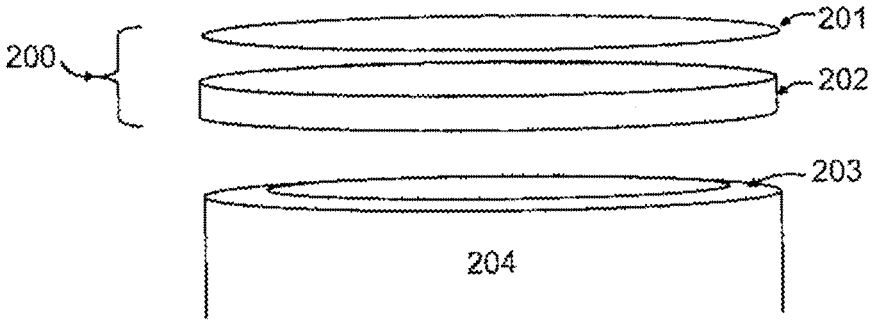
FIG. 2 illustrates an exploded view of components in a cap liner, according to one embodiment.

FIG. 2 illustrates an exploded view of components in a cap liner, according to one embodiment. The cap liner 200 includes a highly diffusive layer 202 and a primary oxygen barrier layer 201 adjacent to one side of the highly diffusive layer 202. The other side of the highly diffusive layer 202 contacts the lip-sealing surface 203 of a bottle 204. The primary oxygen barrier 201 may include films made of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), metalized high-density polyethylene (HDPE), a metalized layer or any oxygen barrier known in the art, according to one embodiment. The highly diffusive layer 202 may include LDPE, EVA, EAA, HPDE, LLDPE, and ULDPE films, according to one embodiment. The highly diffusive layer 202 may include one or more types of highly diffusive polymers known in the art, according to one embodiment. The OTR of the cap liner 200 is controlled by varying the thickness of the highly diffusive layer 202.

Figure 3:
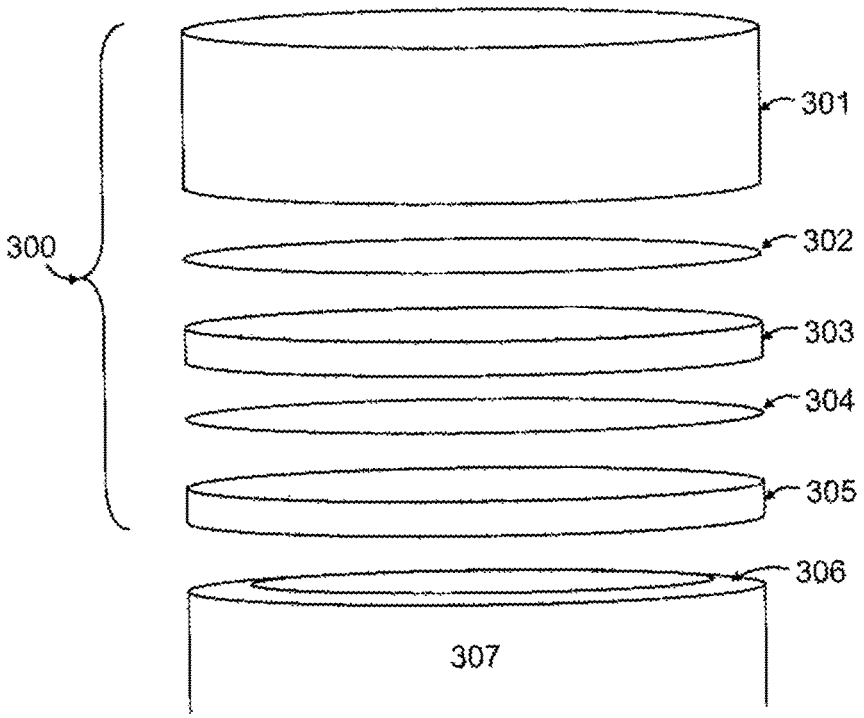
FIG. 3 illustrates an exploded view of components in a cap liner, according to one embodiment.

FIG. 3 illustrates an exploded view of components in a cap liner, according to one embodiment. The cap liner 300 includes a LDPE foam 301, a layer of metal foil 302, a first layer of highly diffusive materials ("B" layer) 303, a layer of PVDC 304 and a second layer of highly diffusive materials ("A" layer) 305. One side of the highly diffusive "A" layer 305 contacts the lip-sealing surface 306 of a bottle 307. The layer of PVDC 304 and the layer of metal foil 302 may be considered as oxygen barrier layers. The materials from the "A" layer 303 and the "B" layer 305 may include one or more types of highly diffusive polymers known in the art, according to one embodiment. The materials from the "A" layer 303 and the "B" layer 305 may include, but are not limited to LDPE, EVA, EAA, HPDE, LLDPE and ULDPE films, according to one embodiment. The thicknesses of the "A" layer 303 and the "B" layer 305 on either side of the layer of PVDC 304 are the OTR controlling factors. The control of oxygen ingress is exercised by varying the thickness of the "B" layer of highly diffusive materials 303 between the layer of metal foil 302 and the layer of PVDC 304, as well as the thickness of the "A" layer of highly diffusive materials 304 between the layer of PVDC 304 and the lip-sealing surface 306 of the bottle 307. The thicknesses of the "A" layer 303 and the "B" layer 305 on both sides of the secondary oxygen barrier layer of PVDC 304 are particularly important for targeting and controlling the desired OTR, including the diffusive layers that are a part of the SARANEX laminate. In a traditional cap liner, the highly diffusive layers on either side of the layer of PVDC are typically 0.5 to 3.5 mils thick. However, the thicknesses of the highly diffusive "A" layer 303 and the highly diffusive "B" layer 305 may vary from 1 to 10 mils thick, depending upon the target OTR, according to one embodiment. A mathematical model that defines how OTR values vary with changes in the thickness of the highly diffusive layers is developed, according to one embodiment. The mathematical model may be a prediction equation created using statistical modeling software (e.g. JMP (a statistical discovery software)) to determine how the thickness of the highly diffusive layers control the OTR of the cap liner using the same layer of PVDC, according to one embodiment. The present invention precisely selects a combination and thicknesses of highly diffusive materials on both sides of an oxygen barrier layer to obtain a desired OTR over a range of OTR.

Figures 4A, 4B:
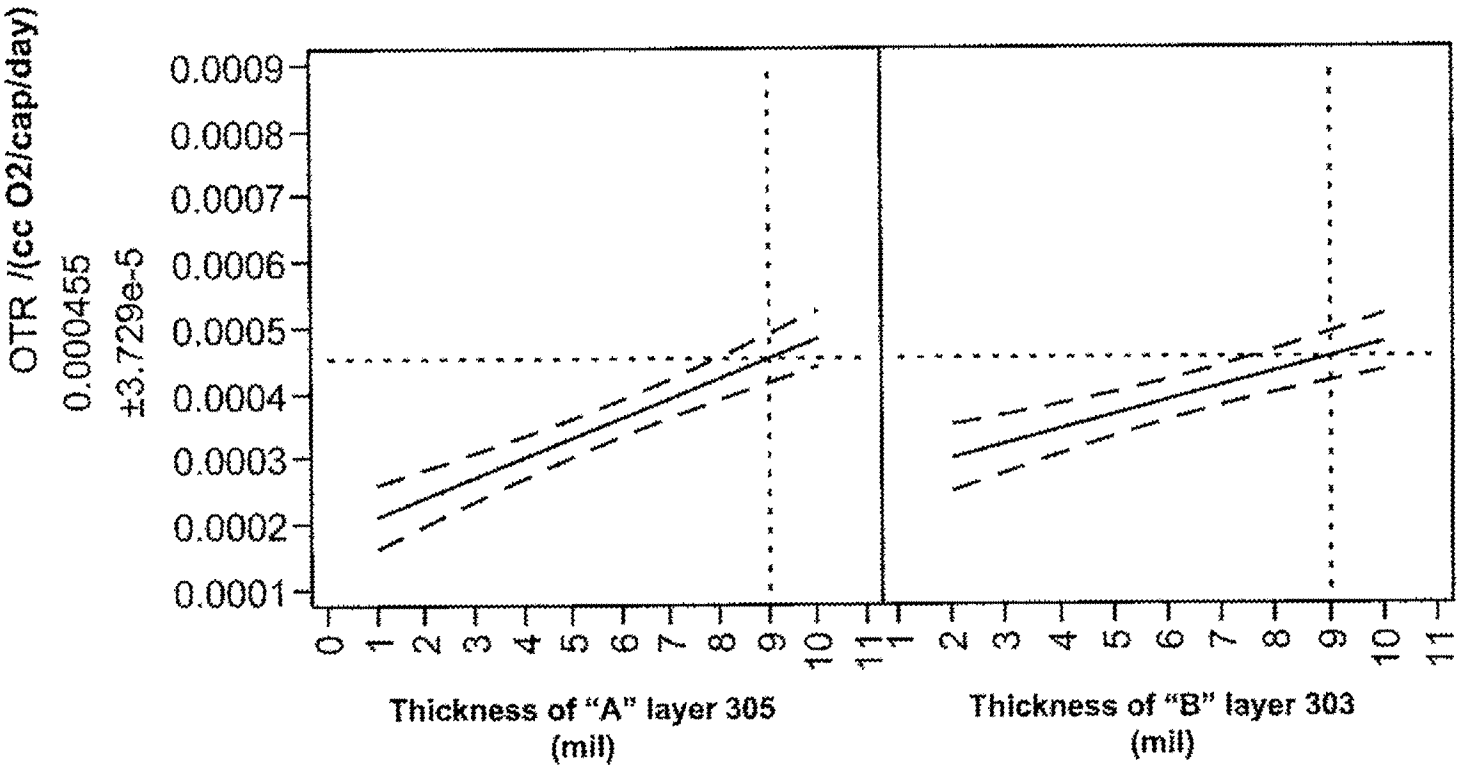
FIG. 4(*a*) illustrates an exemplary plot of a factor effect in a model for OTR control, according to one embodiment.

Referring to FIG. 4(*a*) and FIG. 4(*b*), the respective thicknesses of the "A" layer 305 and "B" layer 303 corresponding to the desired OTR are determined. The model's leverage plots in FIGS. 4(*a*) and 4(*b*) are used to determine the thicknesses of the "A" layer 305 and the "B" layer 303 to achieve the desired OTR. In particular, the plots show that the thickness of the "A" layer 305 between the layer of PVDC 304 and the bottle 307 has a greater effect on OTR than the thickness of the "B" layer 303 on the other side of the layer of PVDC 304 further away from the lip-sealing surface 306 of the bottle 307. According to one embodiment, the unit for OTR is cc O2/cap/day.

The path for the majority of the oxygen diffusion in an aluminum cap is through the liner's edge. Therefore, oxygen is entering the films in the liner through their edge and moves past the lip-sealing surface of the bottle. Oxygen then moves into the headspace of the bottle in a direction perpendicular to the flat surfaces of the liner. The diffusion of gases is proportional to the surface area of edge material exposed to air. The OTR increases with increasing thickness of the highly diffusive layers as more surface area is exposed to air.

The OTR of materials measured in the form of flat sheets is different from the OTR of the same material when inserted into an aluminum cap and secured on a bottle, The normal direction of gas diffusion in a flat sheet is perpendicular to the surface of the sheet. However, the OTR of a liner inside an aluminum cap is primarily controlled by gas diffusion that is perpendicular to the liner's edge.

Figure 5:
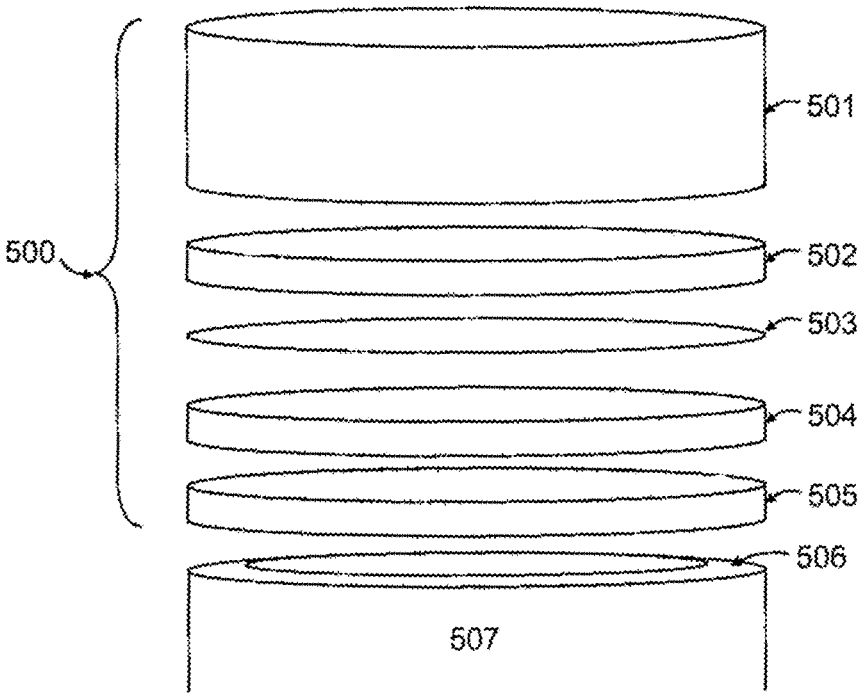
FIG. 5 illustrates an exploded view of components in a cap liner, according to one embodiment.

According to one embodiment, the effect of different SARANEX films and the effect of different thicknesses of highly diffusive EVA adhesive films placed at two locations in the cap liner on OTR were evaluated. Referring to FIG. 5, the cap liner 500 includes a layer of LOPE foam 501, a first layer of EVA ("EVA1" layer) 502, a layer of tin foil 503, a second layer of EVA ("EVA2" layer) 504, and a layer ("C" layer) 505 of SARANEX or LDPE film. One side of the "C" layer 505 contacts the lip-sealing surface 506 of a bottle 507. In a designed experiment, the effect of the layer 505 using three different SARANEX and a 2 mil LDPE film on OTR were evaluated. The effect on OTR of the thickness of the "EVA1" layer 502 and the thickness of the "EVA2" layer 504 placed above and below the tin foil 503 respectively were also evaluated using three thicknesses. Table 1 below illustrates the various configurations for each sample in the experiment.

TABLE 1

| Sample | "EVA1" Layer Thickness (mil) 502 | "EVA2" Layer Thickness (mil) 504 | "C" Layer 505 |
|---|---|---|---|
| 1A | 7 | 1 | LDPE |
| 1B | 7 | 1 | LDPE |
| 1C | 7 | 1 | LDPE |
| 2A | 7 | 1 | SARANEX 3 |
| 2B | 7 | 1 | SARANEX 3 |
| 2C | 7 | 1 | SARANEX 3 |
| 3A | 1 | 1 | SARANEX 1 |
| 3B | 1 | 1 | SARANEX 1 |
| 3C | 1 | 1 | SARANEX 1 |
| 4A | 7 | 7 | SARANEX 1 |
| 4B | 7 | 7 | SARANEX 1 |
| 4C | 7 | 7 | SARANEX 1 |
| 5A | 1 | 7 | SARANEX 3 |
| 5B | 1 | 7 | SARANEX 3 |
| 5C | 1 | 7 | SARANEX 3 |
| 6A | 7 | 7 | SARANEX 0 |
| 6B | 7 | 7 | SARANEX 0 |
| 6C | 7 | 7 | SARANEX 0 |
| 7A | 1 | 1 | SARANEX 0 |
| 7B | 1 | 1 | SARANEX 0 |
| 7C | 1 | 1 | SARANEX 0 |
| 8A | 1 | 7 | LDPE |
| 8B | 1 | 7 | LDPE |
| 8C | 1 | 7 | LDPE |
| 9A | 4 | 4 | SARANEX 0 |
| 9B | 4 | 4 | SARANEX 0 |
| 9C | 4 | 4 | SARANEX 0 |
| 10A | 4 | 4 | SARANEX 1 |
| 10B | 4 | 4 | SARANEX 1 |
| 10C | 4 | 4 | SARANEX 1 |

Figures 6A, 6B, 6C:
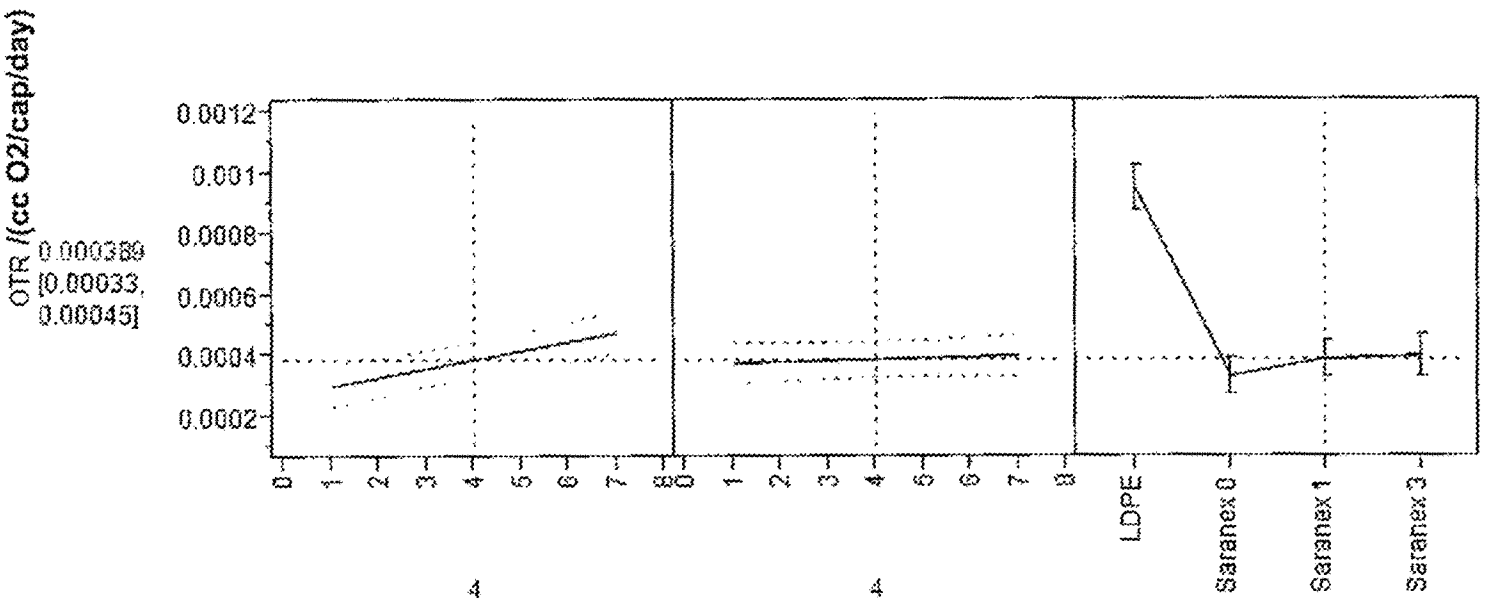
FIG. 6(*a*) illustrates an exemplary plot of the effect of the thickness of highly diffusive layers on OTR, according to one embodiment.

FIGS. 6(*a*)-6(*c*) illustrate the effect of different SARANEX films and the effect of different thicknesses of highly diffusive EVA adhesive films placed at two locations in the cap liner on OTR according to the exemplary cap liner in FIG. 5. Referring to the plot in FIG. 6(*c*), there is little difference between the OTR when three different types of SARANEX are used. However, when LDPE is used for the "C" layer 505, the OTR of the cap liner 500 is significantly higher than the OTR when SARANEX is used. The plot in FIG. 6(*b*) shows that there is no effect on OTR when the thickness of the highly diffusive "EVA1" layer 502 is varied. The plot in FIG. 6(*a*) shows that there is a significant effect on OTR when the thickness of the highly diffusive "EVA2" layer 504 is varied. This indicates that oxygen is bypassing the barrier of the tin foil 503 when the thickness of the "EVA2" layer 504 is increased at this location, i.e. on the side of the tin toil 503 nearer to the lip-sealing surface 506 of the bottle 507.

Figure 7:
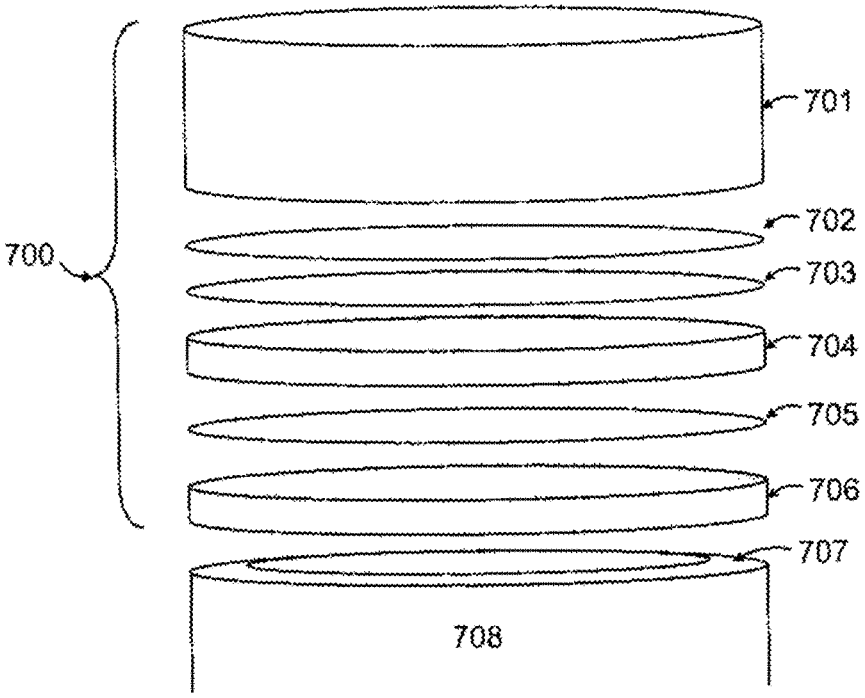
FIG. 7 illustrates an exploded view of components in a cap liner, according to one embodiment.

According to one embodiment, the effects of different thicknesses of highly diffusive films between a PVDC layer and the bottle finish on OTR are evaluated. Referring to FIG. 7, the cap liner 700 includes 50 mil of LDPE foam 701, 1 mil of EVA adhesive 702, 1 mil of tin foil 703, 2 mil of highly diffusive film ("B" layer) 704, a layer of PVDC 705 and a layer of highly diffusive film ("A" layer) 706. The "A" layer of highly diffusive film 706 is between the layer of PVDC 705 and the lip-sealing surface 707 of the bottle 708. The effect of the thickness of the highly diffusive "A" layer 706 on OTR is illustrated using a thickness of 3, 7 and 11 mils of EVA and LDPE as the highly diffusive "A" layer 706. Table 2 below shows that OTR increases with increment in the thickness of the "A" layer 706. The cap liner 700 precisely controls oxygen transmission by varying the thickness of the highly diffusive materials between the PVDC 705 and the lip-sealing surface 707 of the bottle 708.

TABLE 2

| "B" Layer Thickness (mil) 704 | "A" Layer Thickness (mil) 706 | OTR |
|---|---|---|
| 2 | 3 | 0.00023 |
| 2 | 7 | 0.00048 |
| 2 | 11 | 0.00064 |

Figure 8:
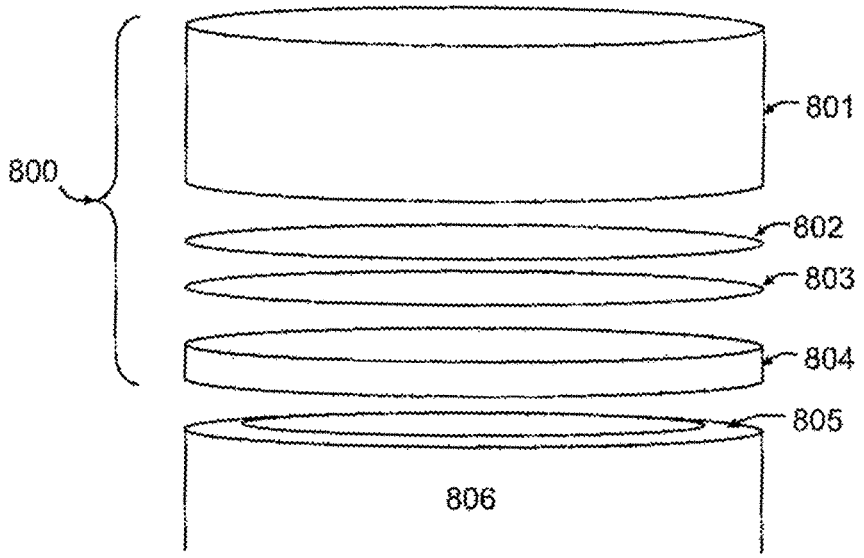
FIG. 8 illustrates an exploded view of components in a cap liner, according to one embodiment.

According to one embodiment, the effects of different thickness of highly diffusive films between a tin foil layer and the bottle finish on OTR are evaluated. Referring to FIG. 8, the cap liner 800 includes 50 mil of LOPE foam 801, 1 mil of EVA adhesive 802, 1 mil of tin foil 803 and a layer of highly diffusive film ("A" layer) 804. The "A" layer of highly diffusive film 804 is between the tin foil 803 and the lip-sealing surface 805 of the bottle 806. The effect of the thickness of the "A" layer 804 on OTR is tested using a thickness of 3, 7 and 11 mils of EVA and LDPE as the highly diffusive "A" layer 804. Table 3 below shows that OTR increases with increment in the thickness of the "A" layer 804. The cap liner 800 precisely controls oxygen transmission by varying the thickness of the highly diffusive materials between the tin foil 803 and the lip-sealing surface 805 of the bottle 806.

TABLE 3

| "A" Layer Thickness (mil) 804 | OTR |
|---|---|
| 3 | 0.00014 |
| 7 | 0.00023 |
| 11 | 0.00041 |

Figure 9:
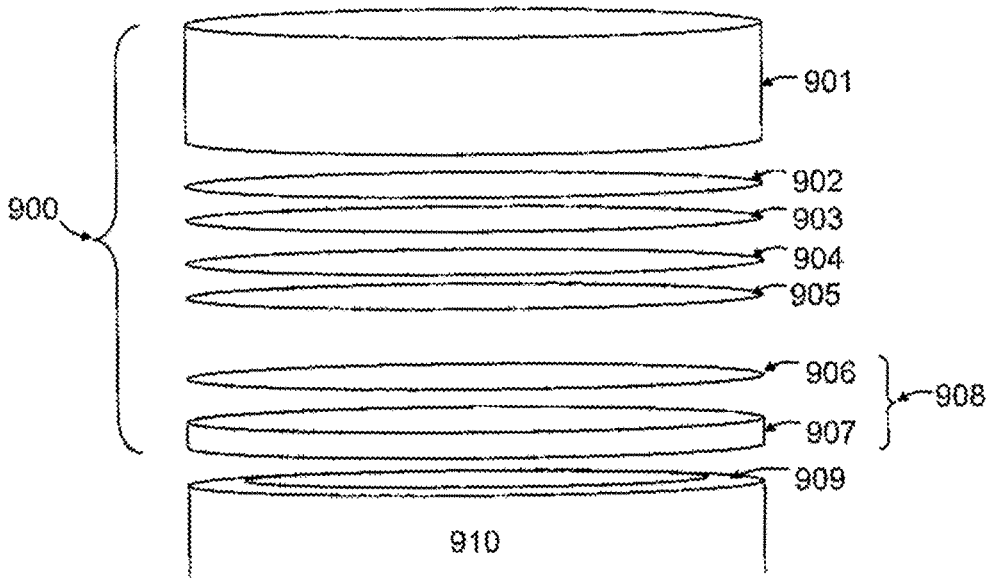
FIG. 9 illustrates an exploded view of components in a cap liner, according to one embodiment.

According to one embodiment, the effect of different thickness of highly diffusive films between semi-permeable Polyester (PET) film and the bottle finish on OTR are evaluated. Referring to FIG. 9, the cap liner 900 includes 50 mil of LDPE foam 901, 1.5 mil of EVA adhesive 902, 0.35 mil of aluminum foil 903, a layer of 1.5 mil of LDPE film ("B" layer) 904, 0.5 mil of semi-permeable PET film 905 and a layer of highly diffusive film ("A" layer) 908. The "A" layer includes 1 mil of EVA adhesive 906 and a LDPE film 907. The "A" layer 908 is between the semi-permeable PET film 905 and the lip-sealing surface 909 of the bottle 910. The effect of a combination of the EVA adhesive 906 and the LDPE film 907 on OTR is evaluated using a thickness of LDPE film 907 of 4, 8 and 12 mils, producing the "A" layer 908 of 5, 9 and 13 mils of highly diffusive films. Table 4 below shows that OTR increases with increment in the thickness of the "A" layer 908 that includes the EVA adhesive 906 and the LDPE film 907. The cap liner 900 precisely controls oxygen transmission by varying the thickness of the highly diffusive materials between the semi-permeable PET firm 905 and the lip-sealing surface 909 of the bottle 910.

TABLE 4

| "B" Layer Thickness (mil) 904 | "A" Layer Thickness (mil) 908 | OTR |
|---|---|---|
| 1.5 | 5 | 0.0011 |
| 1.5 | 9 | 0.0013 |
| 1.5 | 13 | 0.0014 |

Figure 10:
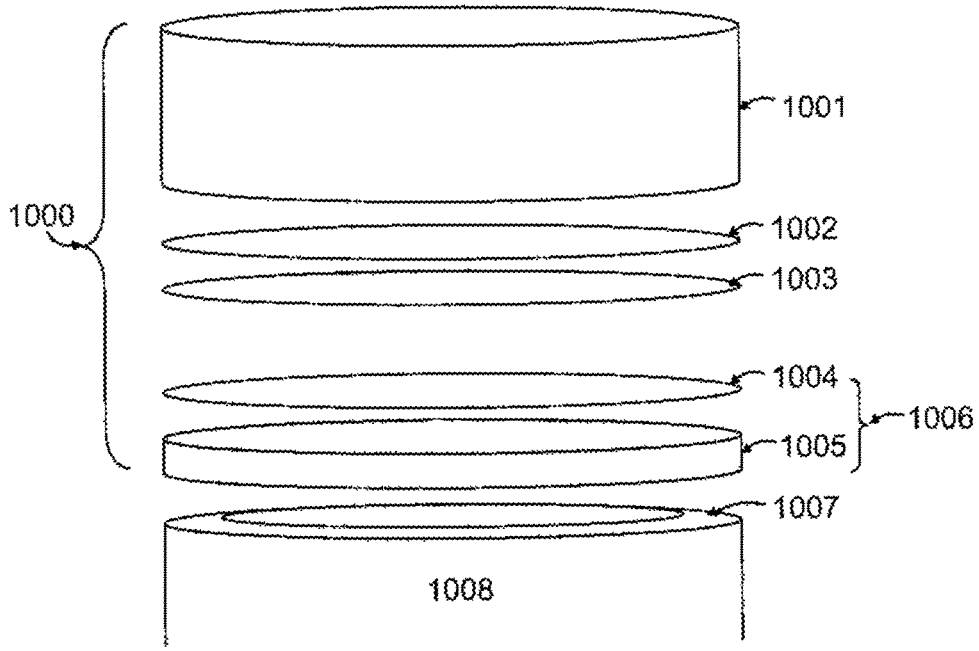
FIG. 10 illustrates an exploded view of components in a cap liner, according to one embodiment.

According to one embodiment, the effect of different thickness of highly diffusive films between a vacuum deposition metalized layer and the bottle finish on OTR are evaluated. Referring to FIG. 10, the cap liner 1000 includes 50 mil of LDPE foam 1001, 1.5 mil of EVA adhesive 1002, 0.35 mil of aluminum metalized PET film 1003 and a layer of highly diffusive film ("A" layer) 1006. The "A" layer 1006 includes 1 mil of EVA adhesive film 1004 and a LDPE film 1005. The "A" layer 1006 is between the vacuum deposition aluminum metalized PET film 1003 and the lip-sealing surface 1007 of the bottle 1008. The effect of a combination of the EVA adhesive 1004 and the LDPE film 1005 on OTR is evaluated using a thickness of LDPE film 1005 of 4, 8 and 12 mils, producing the "A" layer 1006 of 5, 9 and 13 mils of highly diffusive film. Table 5 below shows that OTR increases with increment in the thickness of the "A" layer 1006 that includes the EVA adhesive 1004 and the LDPE film 1005. The cap liner 1000 precisely controls oxygen transmission by varying the thickness of the highly diffusive materials between the aluminum metalized PET film 1003 and the lip-sealing surface 1007 of the bottle 1008.

TABLE 5

| "A" Layer Thickness (mil) 1006 | OTR |
|---|---|
| 5 | 0.0008 |
| 9 | 0.0010 |
| 13 | 0.0012 |

Figure 11:
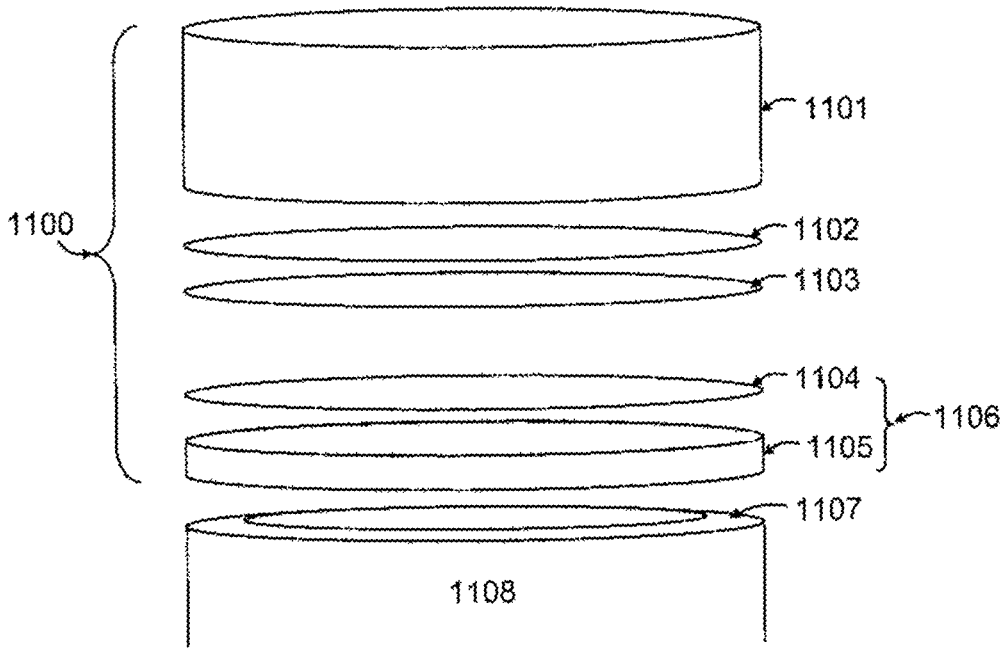
FIG. 11 illustrates a cross-sectional view of components in a cap liner, according to one embodiment.

According to one embodiment, the effect of different thickness of highly diffusive films between a vacuum deposition metalized layer and the bottle finish on OTR are evaluated. Referring to FIG. 11, the cap liner 1100 includes 50 mil of LDPE foam 1101, 1.5 mil of EVA adhesive 1102, 0.35 mil of aluminum metalized LOPE film 1103, and a layer of highly diffusive film ("A" layer) 1106. The "A" layer 1106 includes 1 mil of EVA adhesive film 1104 and a LDPE film 1105. The "A" layer 1106 is between the vacuum deposition aluminum metalized LDPE film 1103 and the lip-sealing surface 1107 of the bottle 1108. The effect of a combination of the EVA adhesive 1104 and the LDPE film 1105 on OTR is evaluated using a thickness of LDPE film 1105 of 4, 8 and 12 mils, producing the "A" layer 1106 of 5.5, 9.5 and 13.5 mils of highly diffusive film. Table 6 below shows that OTR increases with increment in the thickness of the "A" layer 1106 that includes the EVA adhesive 1104 and the LDPE film 1105. The cap liner precisely controls oxygen transmission by varying the thickness of the highly diffusive materials between the aluminum metalized LDPE film 1103 and he lip-sealing surface 1107 of the bottle 1108.

TABLE 6

| "A" Layer Thickness (mil) 1106 | OTR |
|---|---|
| 5.5 | 0.0011 |
| 9.5 | 0.0013 |
| 13.5 | 0.0014 |

According to one embodiment, the present method is used for plastic cap liners. As there is additional diffusion of oxygen through the shell of the plastic cap, adjustments to the model may be necessary.

Figure 12:
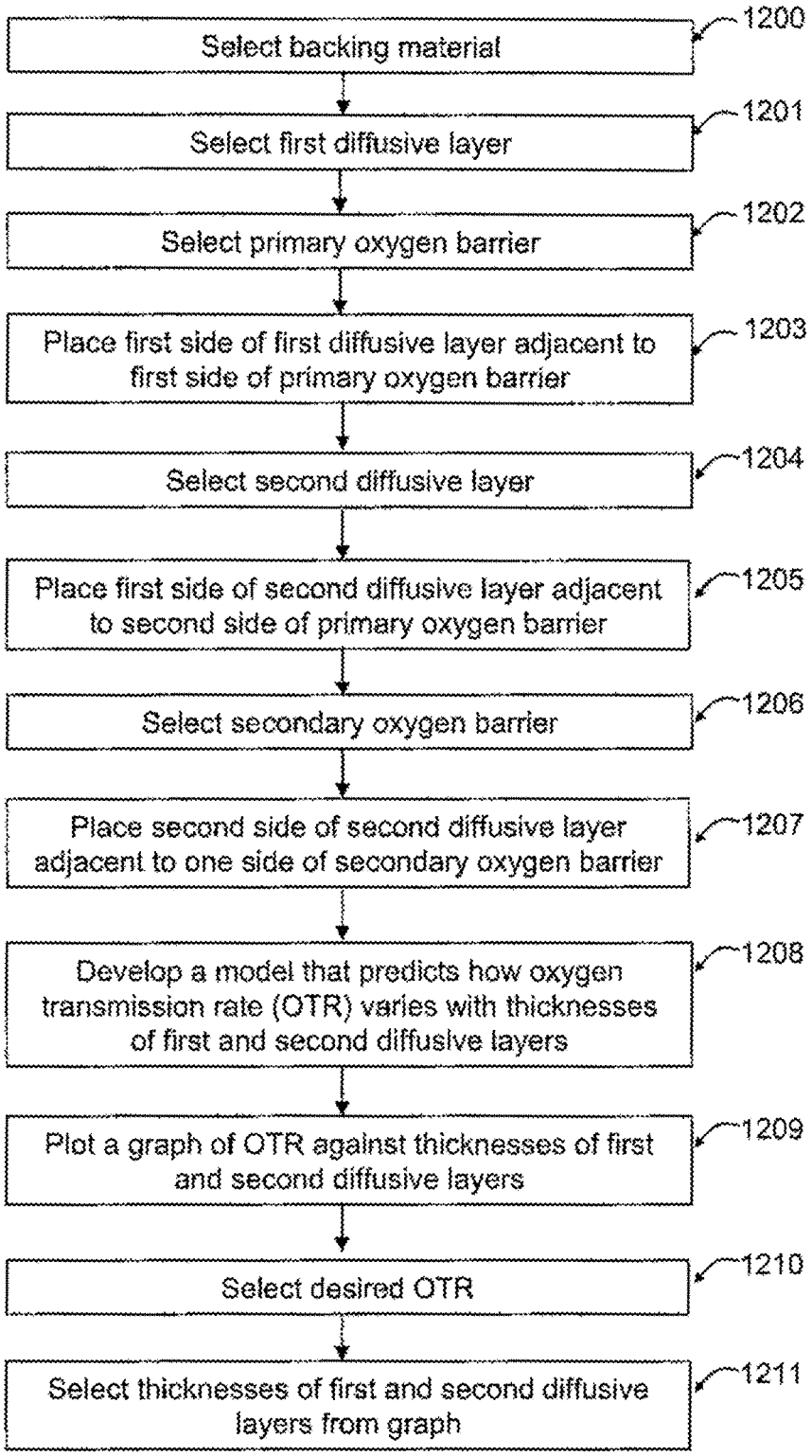
FIG. 12 illustrates a flow chart of an exemplary process for controlling oxygen ingress in cap closures, according to one embodiment.

FIG. 12 illustrates a flow chart of an exemplary process for controlling oxygen ingress in a cap closure, according to one embodiment. At step 1200, a backing material for the liner is selected. The backing material may include expanded LDPE foam, according to one embodiment. At step 1201, a first diffusive layer is selected. The first diffusive layer may include one or more types of highly diffusive polymers known in the art, according to one embodiment. The first diffusive layer may include, but are not limited to LDPE, EVA, EAR, High-density Polyethylene (HPDE), Linear Low-density Polyethylene (LLDPE) and Ultra Low Density Polyethylene (ULDPE) films, according to one embodiment. At step 1202, a primary oxygen barrier is selected The primary oxygen barrier may include films made of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), metalized high-density polyethylene (HDPE), a metalized layer or any oxygen barrier known in the art, according to one embodiment. At step 1203, the first side of the first diffusive layer is placed adjacent to the first side of the primary oxygen barrier. At step 1204, a second diffusive layer is selected. The second diffusive layer may include one or more types of highly diffusive polymers known in the art, according to one embodiment. The second diffusive layer may include, but are not limited to LDPE, EVA, EAA, High-density Polyethylene (HPDE), Linear Low-density Polyethylene (LLDPE) and Ultra Low Density Polyethylene (ULDPE) films, according to one embodiment. At step 1205, the first side of the second diffusive layer is placed adjacent to the second side of the primary oxygen barrier. At step 1206, a secondary oxygen barrier is selected. The secondary oxygen barrier may include films made of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), metalized high-density polyethylene (HDPE), a metalized layer or any oxygen barrier known in the art, according to one embodiment. At step 1207, the second side of the second diffusive layer is placed adjacent to the one side of the secondary oxygen barrier. The backing material, the first diffusive layer, primary oxygen barrier, the second diffusive layer and the secondary oxygen barrier form part of a cap liner in a cap closure, according to one embodiment. After the materials are selected for a part of the cap liner, a model that predicts how OTR varies with the thicknesses of the first and second diffusive layers is developed at step 1208. After the model is developed, a graph of the dependent variable OTR versus changes in the thicknesses of the first and the second diffusive layers is created at step 1209. The desired OTR is selected at step 1210. At step 1211, the thicknesses of the first and second diffusive layers corresponding to the desired OTR is selected from the graph.

The above example embodiments have been described hereinabove to illustrate possible embodiments for controlling oxygen transmission rate of cap liners. Various modifications to and departures from the disclosed example embodiments will occur to those having ordinary skill in the art. The subject matter that is intended to be within the spirit of this disclosure is set forth in the following claims.

I claim:

1. An apparatus, comprising:

a cap; and a cap liner, wherein the cap liner comprises a primary oxygen barrier layer that is approximately 1 mil, an adhesive layer that is 1 mil-7 mil, and a first diffusive layer that is approximately 2 mil, wherein the primary oxygen barrier layer comprises one or more of tin foil, aluminum foil, PVDC, Polyester (PET), EVOH, metalized PET (by vacuum deposition), metalized LDPE, metalized ultra low density polyethylene (ULDPE), metalized linear low-density polyethylene ((LLDPE), and metalized high-density polyethylene (HDPE), wherein the adhesive layer is directly adjacent to the primary oxygen barrier layer and the first diffusive layer, wherein a first side of the first diffusive layer is directly adjacent to a first side of the adhesive layer, wherein a second side of the first diffusive layer contacts a lip-sealing surface of a bottle, and wherein a thickness of the adhesive layer is variable to control an oxygen transmission rate of the cap liner such that the cap liner has a total oxygen transmission rate increase as the thickness of the adhesive layer increases.

2. The apparatus of claim 1, wherein the first diffusive layer comprises one or more of low-density polyethylene (LDPE), ethylene-vinyl acetate (EVA), ethylene acrylic acid (EAA), high-density polyethylene (HDPE), linear low-density polyethylene (LLDPE) and ultra low density polyethylene (ULDPE) film.

3. The apparatus of claim 1, wherein the oxygen transmission rate matches that of bark cork.

4. The apparatus of claim 1, wherein the cap liner further comprises a second diffusive layer, wherein a first side of the second diffusive layer is adjacent to a second side of the primary oxygen barrier layer, and wherein varying a thickness of the second diffusive layer controls the oxygen transmission rate of the cap liner.

5. The apparatus of claim 4, wherein the cap liner further comprises a secondary oxygen barrier layer, wherein a second side of the second diffusive layer is adjacent to a first side of the secondary oxygen barrier layer.

6. The apparatus of claim 5, wherein the secondary oxygen barrier layer comprises one or more of tin foil, aluminum foil, PVDC, Polyester (PET), EVOH, metalized PET (by vacuum deposition), metalized LDPE, metalized ultra low density polyethylene (ULDPE), metalized linear low-density polyethylene (LLDPE), metalized high-density polyethylene (HDPE), and a metalized layer.

7. The apparatus of claim 5, wherein the cap liner further comprises a backing material, wherein a first side of the backing material is adjacent to a second side of the secondary oxygen barrier layer.

8. The apparatus of claim 7, wherein the backing material comprises low-density polyethylene (LDPE) foam.

9. The apparatus of claim 4, wherein the second diffusive layer comprises one or more of low-density polyethylene (LDPE), ethylene-vinyl acetate (EVA), ethylene acrylic acid (EAA), high-density polyethylene (HDPE), linear low-density polyethylene (LLDPE) and ultra low density polyethylene (ULDPE) film.

* * * * *